US011932371B2

(12) United States Patent
Myerscough et al.

(10) Patent No.: US 11,932,371 B2
(45) Date of Patent: Mar. 19, 2024

(54) INFLATABLE WING WITH INTERCHANGEABLE HANDLE OR HANDLES

(71) Applicant: OCEAN RODEO SPORTS INC., Victoria (CA)

(72) Inventors: Richard Myerscough, Victoria (CA); Liam McLean, Victoria (CA); Ross Harrington, Victoria (CA)

(73) Assignee: OCEAN RODEO SPORTS INC., Victoria (CA)

( * ) Notice: Subject to any disclaimer, the term of this patent is extended or adjusted under 35 U.S.C. 154(b) by 66 days.

(21) Appl. No.: 17/695,189

(22) Filed: Mar. 15, 2022

(65) Prior Publication Data

US 2022/0297810 A1 Sep. 22, 2022

Related U.S. Application Data

(60) Provisional application No. 63/161,790, filed on Mar. 16, 2021.

(51) Int. Cl.
*B63H 8/12* (2020.01)
*B63H 8/56* (2020.01)

(52) U.S. Cl.
CPC ..... *B63H 8/12* (2020.02); *B63H 8/56* (2020.02)

(58) Field of Classification Search
CPC ..... B63H 8/12; B63H 8/56
See application file for complete search history.

(56) References Cited

U.S. PATENT DOCUMENTS

2023/0294807 A1 9/2023 Pajank

FOREIGN PATENT DOCUMENTS

| | | | |
|---|---|---|---|
| DE | 20 2021 101 633 U1 | | 7/2021 |
| DE | 202021101663 U1 | | 7/2021 |
| DE | 202021104654 | * | 9/2021 |
| DE | 20 2021 104 654 U1 | | 11/2021 |
| DE | 20 2021 003 874 U1 | | 3/2022 |

* cited by examiner

*Primary Examiner* — Justin M Benedik

(57) ABSTRACT

An improved inflatable wing and kit including an inflatable airframe, a center strut connectable to the airframe, a wing panel connectable to the airframe and to the center strut, and a handle. The handle may have first and second ends, each configured to removably connect to the center strut via connection devices on the center strut which are configured to receive the first and second ends of the handle.

4 Claims, 4 Drawing Sheets

INFLATABLE WING WITH INTERCHANGEABLE HANDLE OR HANDLES

COPYRIGHT NOTICE

This patent document contains material which is subject to copyright protection. The copyright owner has no objection to the facsimile reproduction by anyone of this patent document as it appears in the Patent and Trademark Office patent file or records, but otherwise reserves all copyright rights whatsoever.

FIELD OF THE INVENTION

The invention relates to the field of wing foiling and in particular, to a wing used in wingsurfing with an interchangeable handle or handles.

BACKGROUND OF THE INVENTION

Borrowing from sports such as kite surfing, windsurfing, hydrofoil surfing and wing powered snow and land sports, Wing Foiling is a relatively new water sport made possible by recent developments of both inflatable wings and water sport hydrofoils used for surfing type applications.

Proven materials and manufacturing techniques from inflatable kites, combined with easier to use hydrofoils have been combined to create this new sport Wing foiling.

The wings currently in use an inflatable air frame to provide buoyancy in the water and allows for easy handling and storage.

The most popular method to hold an inflatable wing is by at least two handles located on the center strut of the wing: one for front hand and one for back hand. However, most wings have several other handles to allow for various hand placements along the center strut. Also proving popular are partial booms that mount the front end on the leading edge spar and the back end is nested into the aft end of the center strut.

Accordingly, a need exists for an improved wing that allows for multiple handle configurations. Other objects of the invention will be apparent from the description that follows.

SUMMARY OF THE INVENTION

According to the present invention there is provided an improved inflatable wing. The wing may include an inflatable airframe, a center strut connected to the airframe, a wing panel connected to the airframe and center strut, and a handle having first and second ends, where the first and second ends are configured to removably connect to the center strut. Connection devices on the center strut may be provided and configured to receive the first and second ends of the handle.

The improved inflatable wing may also include first and second fittings, each configured to connect or removably attach to the first and second ends of the handle and configured to space the handle from the center strut.

The connection devices may include attachment webbings on said center strut configured to receive the fittings.

According to another embodiment of the invention, there is provided an improved inflatable wing kit. The kit may include an inflatable airframe, a center strut, a wing panel and a handle. The handle may have first and second ends each configured to connect or removably connect to the center strut. The improved inflatable wing kit may also include connection devices connectable on the center strut and configured to receive the first and second ends of the handle.

The improved inflatable wing kit may also include first and second fittings, each configured to connect or removably attach to the first and second ends of the handle and configured to space the handle from the center strut.

The connection devices may include attachment webbing connectable to the center strut and configured to receive the fittings.

The unique feature of the interchangeable handle system is the ability for the end user to set up their wing to their preferred handle setup. They can use a single long handle, which offers unlimited hand positions along its length without having to remove their hand to reposition.

Contrary they can install multiple handles that require more hand movements during maneuvers, however, are soft and easier to pack.

The handle is also providing more distance from the wings spar which is preferred to clear the wing tip over the water, snow or land while in use.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
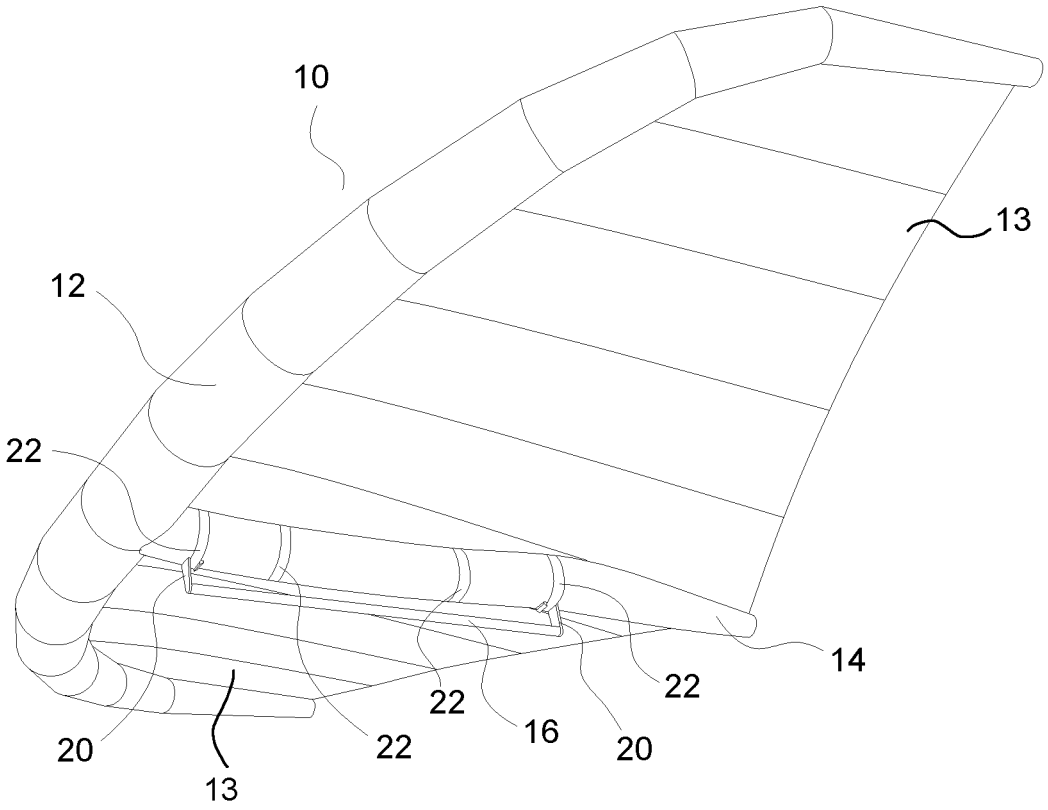
FIG. 1 is a perspective view of a wing with an interchangeable handle system.
Figure 2:
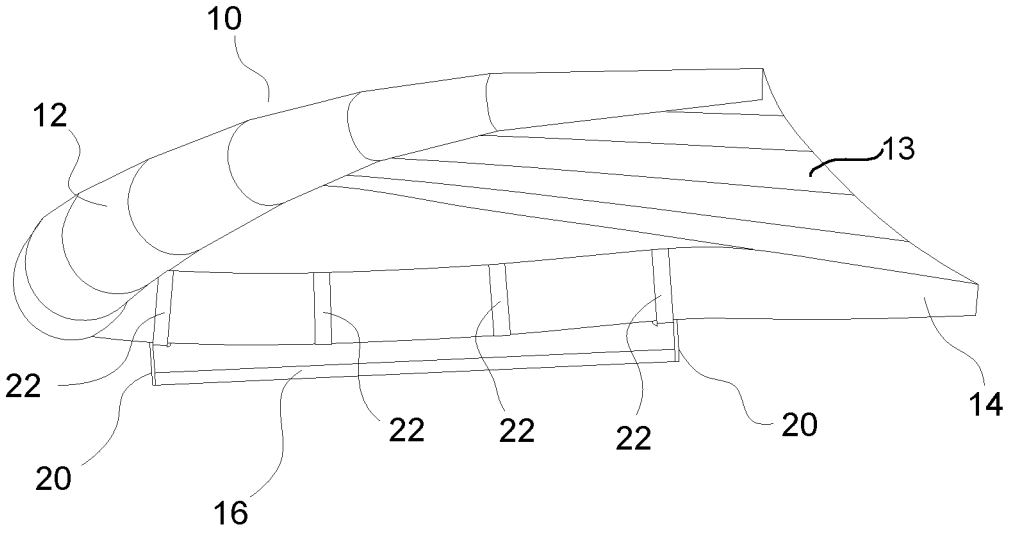
FIG. 2 is a side view of a wing with an interchangeable handle system using a single long handle.
Figure 3:
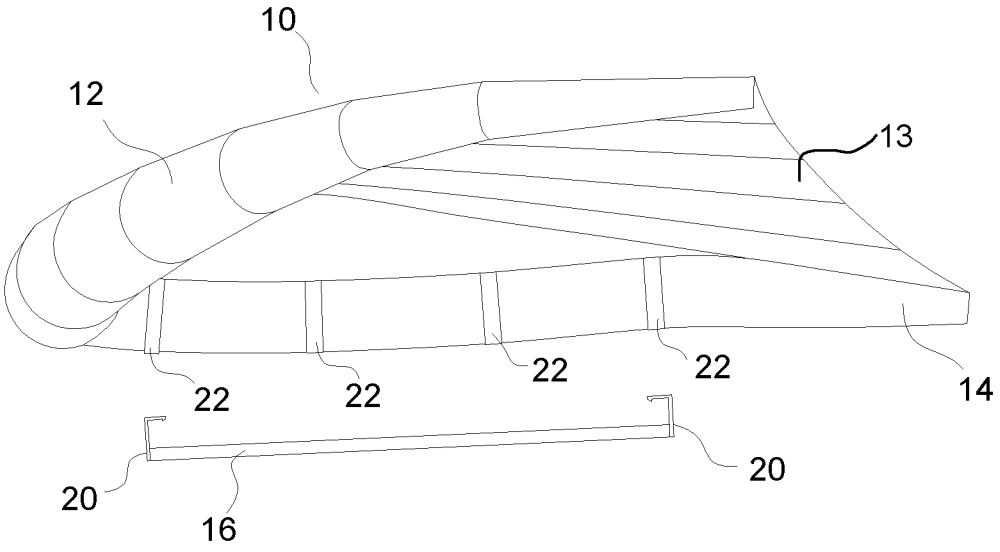
FIG. 3 is a side view of a wing with an interchangeable handle system with a single long handle detached.

Referring to FIGS. 1 and 2 there is shown an inflatable wing 10 with an interchangeable single long handle 16. Inflatable wing 10 includes an airframe 12, wing panel 13, and center strut 14. Single long handle 16 is removably connected to center strut 14 via angled fittings 20 which are connected or removably connectable to the handle's ends. Preferably, angled fittings 20 are configured to create a gap between the strut 14 and handle 16 to allow freedom of movement for the user's hands on the handle. Along the center strut 14 are connection devices to removably attach the fittings thereto. Preferably, these devices are attachment webbings 22 suitably spaced along the strut 14 and configure to engage the fittings 20. As those skilled in the art will appreciate, any connection devices will do.

Figure 4:
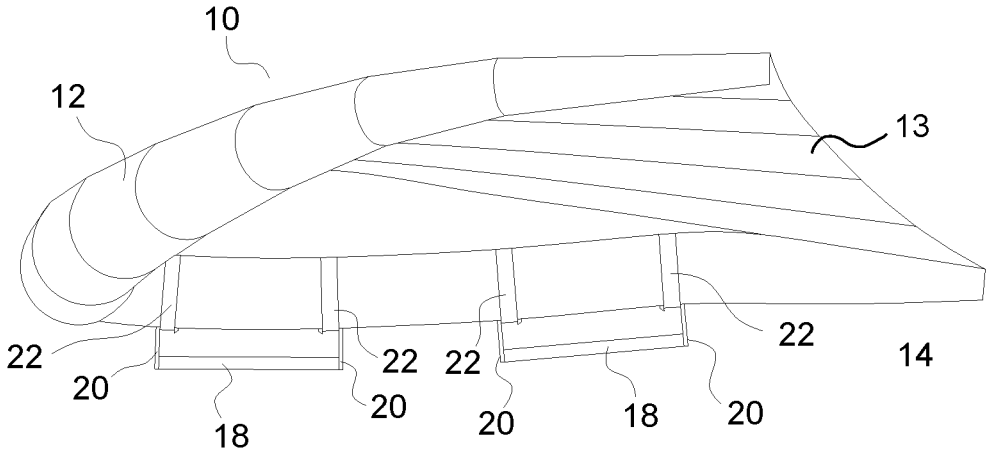
FIG. 4 is a side view of a wing with an interchangeable handle system using multiple handles.
Figure 5:
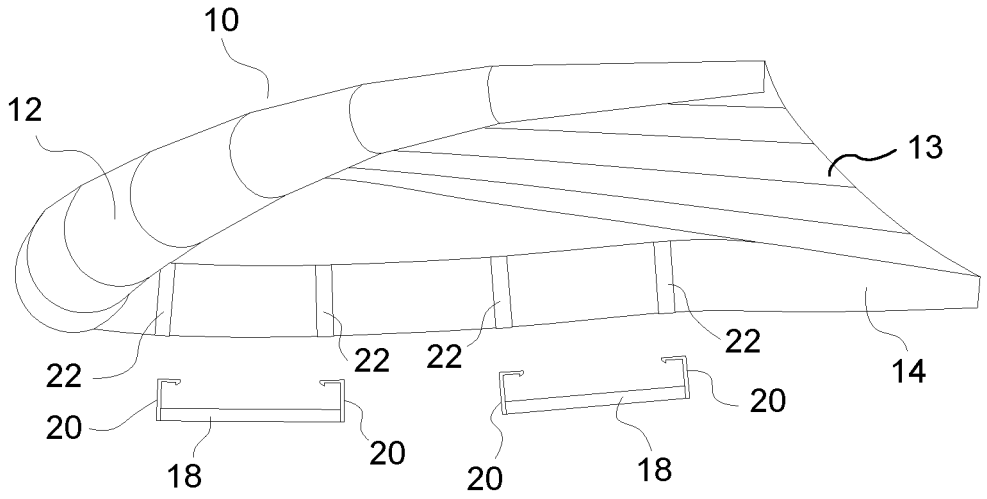
FIG. 5 is a side view of a wing with an interchangeable handle system with multiple handles detached.

Referring to FIGS. 4 and 5 there is shown an inflatable wing 10 with interchangeable multiple short handles 18. Again, inflatable wing 10 includes an airframe 12, wing panel 13, and center strut 14. Short handles 18 are removably connected to center strut 14 via angled fittings 20 which are connected or removably connectable to each handles' ends. Preferably, angled fittings 20 are configured to create a gap between the strut 14 and each handle 18 to allow freedom of movement for the user's hands on the handles. Along the center strut 14 are connection devices to removably attach the fittings 20 thereto. Preferably, these devices are attachment webbings 22 suitably spaced along the strut 14 and configure to engage the fittings 20. As those skilled in the art will appreciate, any connection devices will do.

In both the single long handle and multiple short handle configurations, the fittings 20 may secure to the attachment webbings 22 via friction. To additionally secure the fittings 20 to the attachment webbings 22, straps, ropes, clamps, fasteners and other devices may be used, as those skilled in the art will appreciate. For example, a user may secure the fittings 20 to the attachment webbings 20 via loop to loop, knots, screws, slides and the like.

Figure 6:
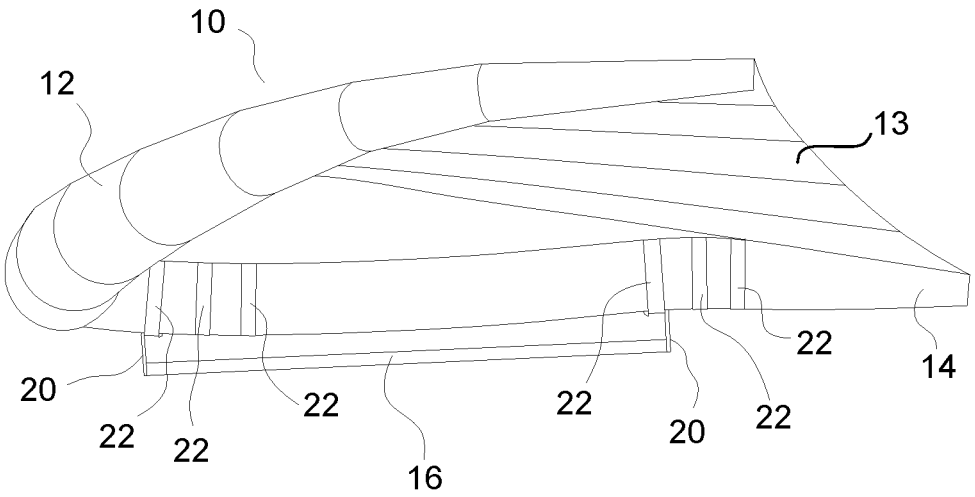
FIG. 6 is a side view of a wing with an interchangeable handle system showing multiple attachment positions to allow for adjustment.

Referring to FIG. 6, attachment webbing 22 can be movably spaced along center strut 14 to customize a user's handle position and handle preferences.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. An improved inflatable wing comprising:

an inflatable airframe;

a center strut connected to said airframe;

a wing panel connected to said airframe and to said center strut;

a handle having first and second ends, wherein said first and second ends are configured to removably connect to said center strut;

connection devices on said center strut configured to receive said first and second ends of said handle; and first and second fittings, each configured to connect to said first and second ends of said handle and configured to space said handle from said center strut, wherein said connection devices comprise attachment webbing on said center strut configured to receive said fittings.

2. The improved inflatable wing of claim 1, wherein each of the first and second fittings is configured to removably attach to said first and second ends of said handle.

3. An improved inflatable wing kit:

an inflatable airframe;

a center strut connectable to said airframe;

a wing panel connectable to said airframe and center strut;

a handle having first and second ends, wherein said first and second ends are configured to removably connect to said center strut;

connection devices connectable to said center strut and configured to receive said first and second ends of said handle; and first and second fittings, each configured to connect to said first and second ends of said handle and configured to space said handle from said center strut, wherein said connection devices comprise attachment webbing connectable to said center strut and configured to receive said fittings.

4. The improved inflatable wing kit of claim 3, wherein each of the first and second fittings is configured to removably attach to said first and second ends of said handle.

* * * * *